United States Patent [19]

Pujol

[11] 4,121,776

[45] Oct. 24, 1978

[54] COOLED HORIZONTAL-AXLE GRINDER

[76] Inventor: Carlos Oliver Pujol, Marina St. No. 51, Badalona (Barcelona), Spain

[21] Appl. No.: 831,763

[22] Filed: Sep. 9, 1977

Related U.S. Application Data

[63] Continuation-in-part of Ser. No. 729,298, Oct. 4, 1976, abandoned.

[30] Foreign Application Priority Data

Jul. 20, 1976 [ES] Spain ..... 449.976

[51] Int. Cl.[2] ..... B02C 23/36

[52] U.S. Cl. ..... 241/46.11; 241/67

[58] Field of Search ..... 241/46 R, 46.11, 46.15, 241/65, 66, 67

[56] References Cited

U.S. PATENT DOCUMENTS

| | | | |
|---|---|---|---|
| 1,141,898 | 6/1915 | Merritt | 241/66 |
| 2,389,816 | 11/1945 | Richardson | 241/65 |
| 3,762,657 | 10/1973 | Schieritz | 241/66 |
| 3,957,210 | 5/1976 | Durr | 241/46.11 |
| 3,990,641 | 11/1976 | Weston | 241/65 |

*Primary Examiner*—Granville Y. Custer, Jr.
*Attorney, Agent, or Firm*—Blanchard, Flynn, Thiel, Boutell & Tanis

[57] ABSTRACT

A cooled horizontal-axle grinder for the predispersion of solids in liquids, of the type which incorporates a grinding chamber with a double wall for cooling, in which chamber are presented grinding bodies such as balls generally introduced by the treated product intake port and extracted by an outlet in the lower part of the chamber. The grinder is equipped with a circulating pump for the product to be treated, which product circulates in a continuous manner through the grinding chamber. The grinder axle carries interchangeable discs or agitator elements interspersed with spacers. The grinding chamber incorporates a slot or static sieve which retains the grinding bodies in the chamber while permitting passage only of the product. The grinding chamber jacket is mounted in an unconstrained arrangement attached by one end to a fixed part of the machine but free at the opposite extreme in such a manner as to be capable of absorbing the differential expansion which may be produced between the interior grinding zone and the exterior cooling zone.

7 Claims, 5 Drawing Figures

19
3
2
20
8
7
6

14
13
7
12

COOLED HORIZONTAL-AXLE GRINDER

CROSS-REFERENCE TO RELATED APPLICATION

This application is a continuation-in-part of my copending application Ser. No. 729,298, filed Oct. 4, 1976, now abandoned.

SUMMARY OF THE INVENTION

The present invention refers to improvements in cooled horizontal-axle grinders for the predispersion of solids in liquids.

In general terms, the improvements which are the object of the invention deal with means of cooling the axle and the grinding chamber of a cooled horizontal axle grinder, for the predispersion of solids in liquids of high or medium viscosity, in which there are present grinding bodies, for example balls of a suitable material, generally introduced through an intake port and extracted by means of a port situated in the lower part of the grinding chamber, and which has a double wall for the corresponding cooling mechanism (given that during the treatment temperatures are achieved which are excessive for the material to be treated) and, in turn, a circulating pump for the liquid coolant in question. In the grinder being considered there is an axle or shaft on which are mounted corresponding interchangeable agitator discs situated at predetermined distances from each other by means of spacers, which shaft is driven by a corresponding motor through a suitable transmission system and speed regulator. The system also contains a pump and flow regulator which impel the material being treated.

As has been indicated above, the improvements refer to the type of grinders described, and comprises an assembly system for the grinding chamber jacket, which assembly system provides an unconstrained arrangement which permits the absorption of differential expansion produced between the internal and external parts of the grinding chamber jacket so as to avoid cracks or ruptures in the chamber jacket welding caused by the stresses set up by such differential expansion between its component parts. Another of the improvements of the invention comprises a cooling system for the axle which is designed to dissipate the heat produced by friction between parts, whether in the axial bearings, the rotary bearings or in the sealing or tightening element, to which end the axle is provided with a tube with a corresponding guide at one end to permit the introduction or drainage of the liquid coolant.

The cooling system for the sealing or tightening element of the machine can be realized by means of a membrane pump of known type, activated by means of an eccentric situated on the grinder shaft, which eccentric acts on the operating rod of the pump.

This type of grinder further contains a slot or static sieve, which acts as a filter, and which retains the grinding bodies while giving passage only to the treated material.

The material being treated circulates through the grinding chamber in a continuous fashion, impelled by the circulating pump.

DETAILED DESCRIPTION

Figure 1:
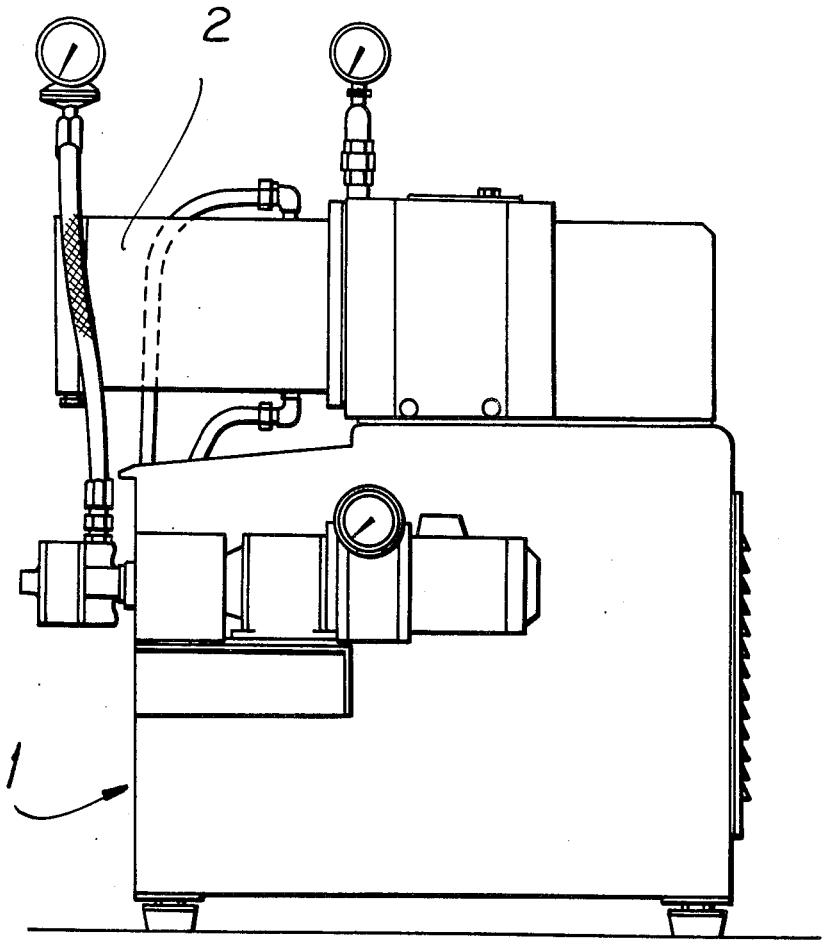
FIG. 1 shows a lateral elevation of the machine assembly.

With reference to the drawings, the implementation comprises a machine 1 of a type which includes a plural-wall grinder body 2, having therein a horizontal axle. The body 2 includes a grinding chamber jacket 3 which is mounted in an axially unconstrained manner by means of an annular flange 4 at one of its extremes which projects outwards and permits the jacket 3 to be fixed to the body 5, while leaving the opposite extreme of the jacket 3 totally free to permit the absorption of the differential expansion between the jacket 3 and the surrounding cooling jacket 6 due to the temperature difference between the internal grinding and mixing chamber 27 and the external cooling chamber 28, thus avoiding cracks or ruptures in the jacket body welding caused by the stresses set up by differential thermal expansion between its component parts.

Figure 2:
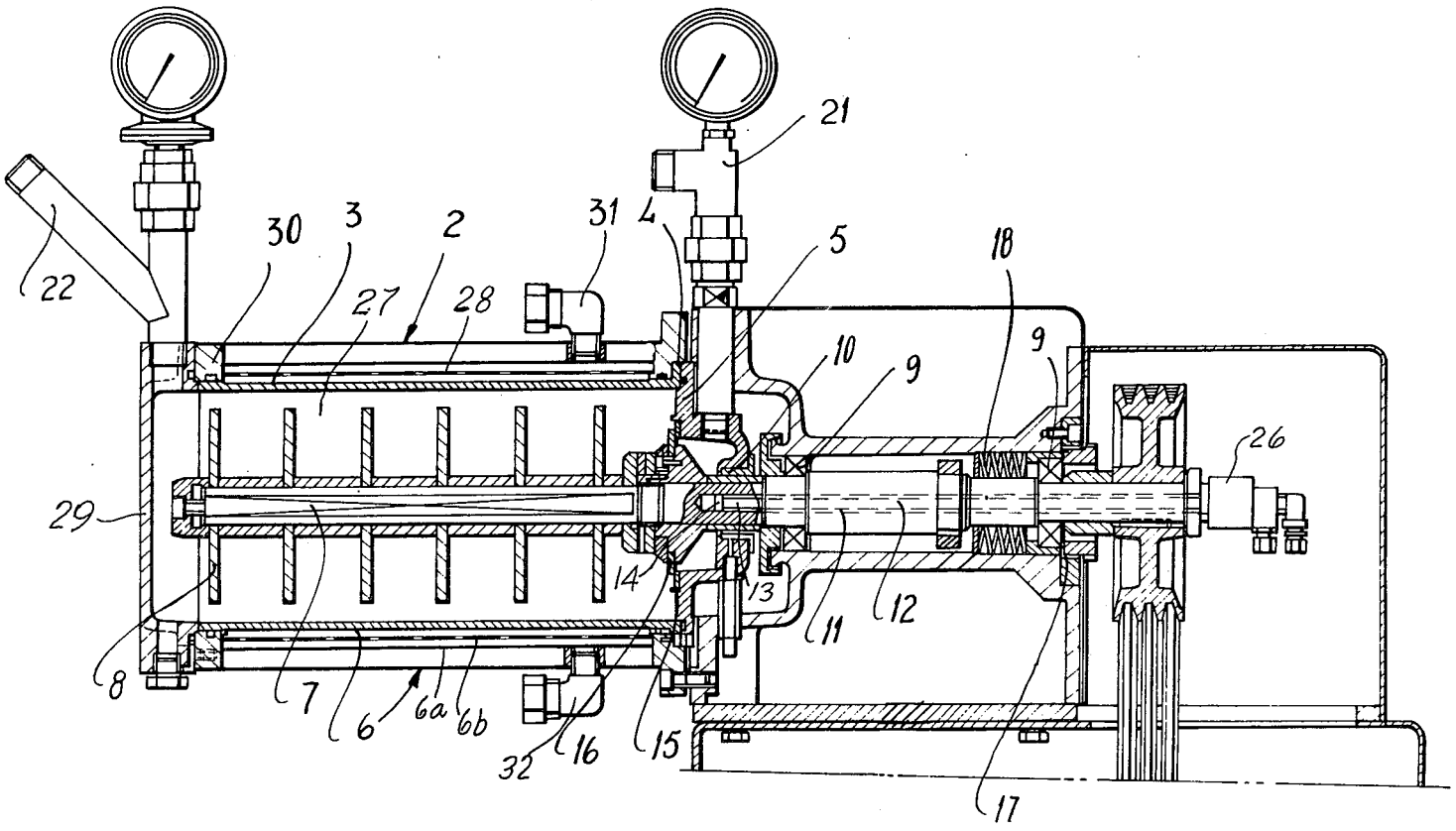
FIG. 2 corresponds to a longitudinal sectional view in elevation of the grinding chamber and the axle support.
Figure 5:
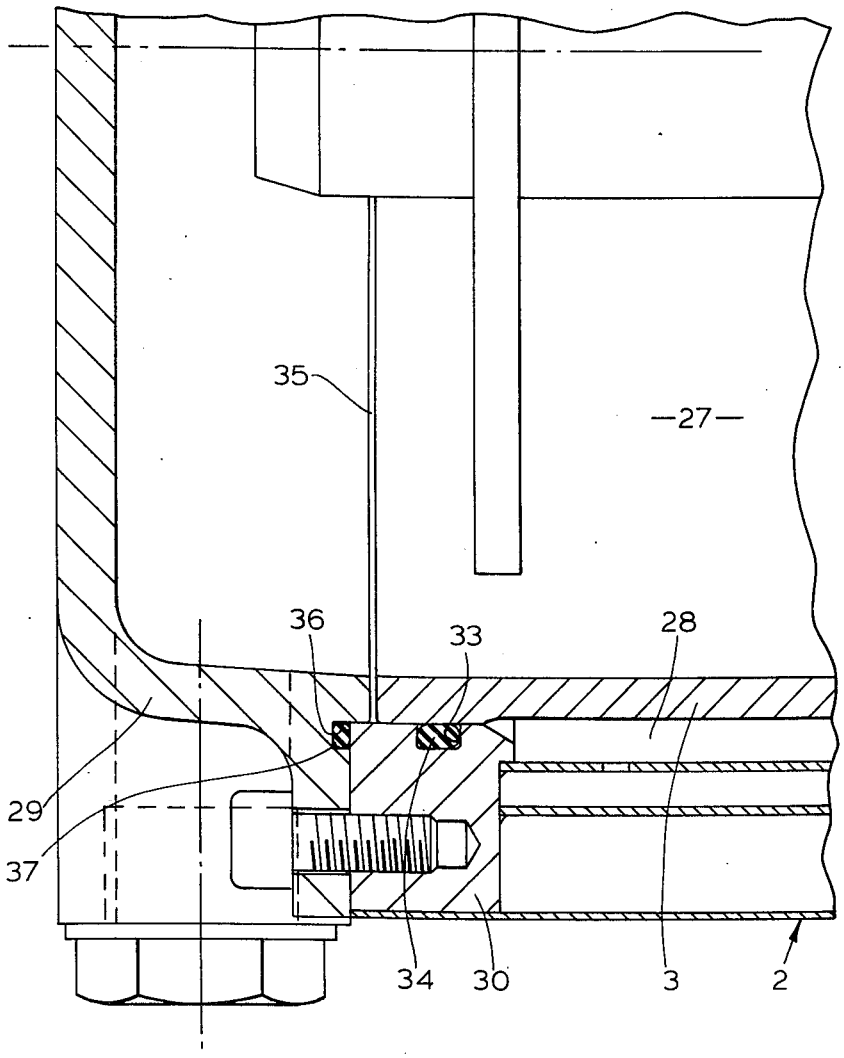
FIG. 5 is an enlarged fragmentary sectional view of the grinding body.

Referring to FIG. 5, the grinder body 2 includes not only the grinding jacket 3 and the surrounding cooling jacket 6, but also includes an end cap 29. This end cap is fixedly but removably secured, as by means of threaded screws, to an annular flange 30. This latter flange 30 is in turn fixedly secured, as by being welded, to the adjacent end of the cooling jacket 6. This jacket 6, in the illustrated embodiment, includes an outer annular wall **6*a* spaced from the grinding chamber jacket 3 and defining the cooling chamber 28 therebetween. The cooling chamber is, in the illustrated embodiment, additionally divided by a further intermediate wall 6*b* which is provided with a plurality of perforations therethrough so as to permit the cooling fluid to circulate throughout the chamber 28. Suitable cooling fluid is supplied to and removed from the cooling chamber by means of the connections 31 and 32, respectively, as shown in FIG. 2. The other ends of the walls 6*a* and 6*b* are fixedly secured to the flange 4**, as by welding.

To provide a floating arrangement between the grinding chamber jacket 3 and the remainder of the chamber body 2, the flange 30 is axially slidably supported on the end of the jacket 3. This flange 30 has an annular recess 33 formed in the inner periphery thereof, and an annular elastomeric or other suitable deformable sealing ring 34 is disposed within this groove and positioned for creating a slidable sealed engagement with the outer wall of the jacket 3. This seal ring 34 prevents the cooling fluid from escaping from the cooling chamber 28. In addition, there is normally provided a small clearance space 35 between the free end of the jacket 3 and the cap 29, which clearance space permits axial expansion or contraction of the jacket due to the heating and cooling thereof, inasmuch as the cap 29 is fixedly interconnected directly to the cooling jacket 6.

To prevent escape of the product from the grinding chamber 27 due to the presence of the clearance gap 35, the flange of cap 29 is also provided with an annular groove 36 formed therein. This groove contains a further annular elastomeric or other compressible sealing ring 37 disposed therein and positioned in sealing engagement with the end wall of the mounting flange 30.

Due to the construction of the grinder body 2, as described above, the differential expansion that is produced between the inner and outer parts of the grinder body, such as between the jackets 3 and 6, is thus readily compensated for due to the ability of the grinding jacket 3 to axially expand or contract relative to the remainder of the body 2. One end of the jacket 3, by being axially unrestrained, thus prevents breakage of the body welds due to the differential thermal expansion of the body parts. At the same time, the floating arrangement for the free end of the jacket 3 permits a sealed relationship to be achieved for both the cooling chamber and the grinding chamber.

An inlet tube 22 communicates with one end of the chamber defined within the jacket 3 so as to supply the material thereto. The product is removed from this chamber via an outlet tube 21.

The rotatable axle or shaft 7, on which is mounted the agitator discs 8, is equipped with a cooling system designed to dissipate the heat generated in those areas subject to friction, whether in the rotary bearings 9 or in the sealing or tightening element 10. To this end, the axle 7 is equipped with an interior axial conduit 12 in the rearward support area 11, in which conduit there is situated a tube 13, on the extreme end of which is mounted a teflon guide 14. This cooling system includes a rotatable dual-passage joint 26 mounted on friction seals. Its function is to permit the introduction and drainage of the cooling water by means of the interior of tube 13 and the annular space which exists between this tube and the internal wall of the axial conduit 12.

As is known, this type of grinder machine has an element which acts as a filter, and which retains, in the interior of the grinding chamber, the grinding bodies while giving passage only to the material as it is treated. In FIG. 2, there is shown a filtering element of known type such as "a slot filter" which is composed of two parts, one part 15 being stationary while the other part 16 rotates with the axle 7. The separation space or annular "slot" which exists between parts 15 and 16 is adjustable within certain limits, by means of an adjustment mechanism which includes the rotatable threaded sleeve 17 and the flexible washer-type springs 18.

Figure 4:
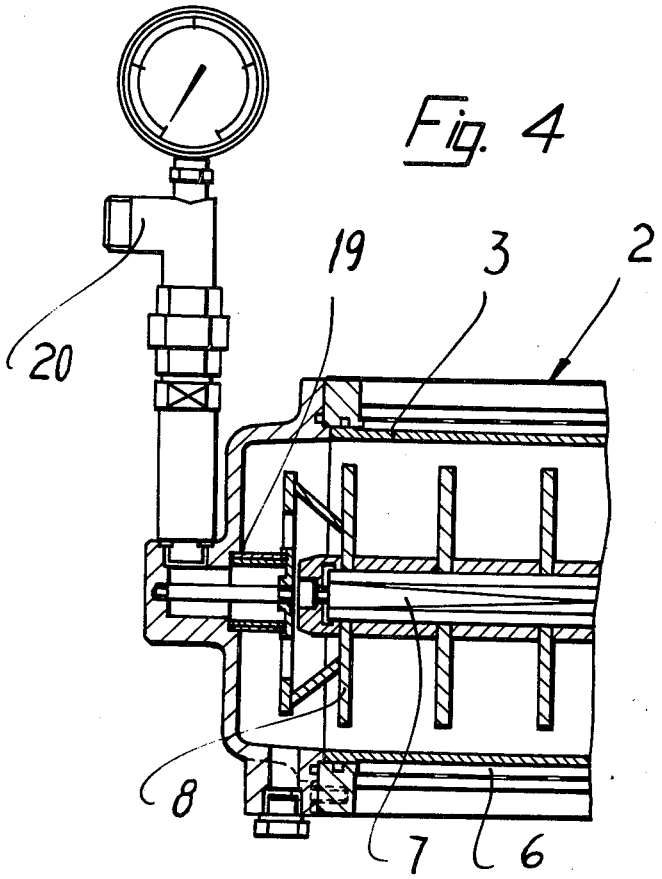
FIG. 4 corresponds to a partial sectional view of the grinding chamber and, as an alternative, depicts a static sieve of known type which is situated in alignment with the machine axle at the opposite extreme to the driven end of this axle.
Figure 3:
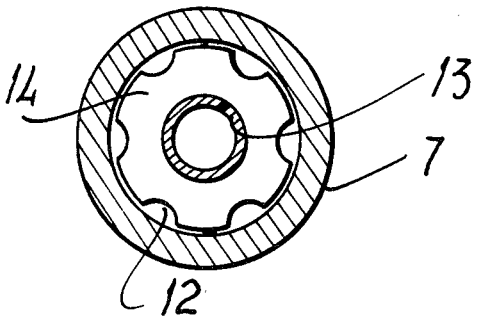
FIG. 3 shows a transverse section through the axle, and demonstrates schematically the axle cooling system.

FIG. 4 shows a variation of the filtering element, consisting in this case of a static sleevelike sieve 19, which is aligned with the axle of the machine and is situated at the opposite extreme to the driven end of this axle. In this variation, the material outlet tube 20 is located in the end of the chamber, adjacent to the static sieve 19, but it may be in a reversed position as shown in FIG. 2.

Manometers and thermometers may be incorporated in the system as required (it being usual to locate a thermometer in the treated material outlet tube), as well as some type of safety mechanism such as pressure switches, etc.

The invention, in essence, can be implemented in other forms of realization which may differ in detail from that outlined by way of example in the above description, which forms of realization will be equally capable of achieving the type of protection sought. Thus, it may be constructed in whatever shape or form, and with whatever materials and means most suitable, while all of this remains encompassed within the spirit of the claims.

I claim:

1. In a cooled horizontal-axle grinder, such as for the predispersion of solids in liquids, which grinder includes a housing, a double-wall jacket structure defining therein both a grinding chamber and a cooling chamber, grinding bodies such as balls positioned within said grinding chamber, a rotatable agitator shaft extending through said grinding chamber and supported for rotation about a substantially horizontal axis, a plurality of agitator discs mounted on the shaft for rotation therewith, and a filter structure for straining the treated material which is withdrawn from the grinding chamber, comprising the improvement wherein said jacket structure includes an inner sleeve member defining said grinding chamber in the interior thereof and an outer sleeve member spaced outwardly from and disposed in surrounding relationship to the inner sleeve member, said inner and outer sleeve members defining the cooling chamber therebetween, one end of said inner sleeve member and the adjacent end of said outer sleeve member being fixedly mounted on said housing, and the other ends of said inner and outer sleeve members being relatively mounted in an unconstrained manner so as to be capable of absorbing and compensating for the differential axial expansion which may be produced between the inner and outer sleeve members due to the different temperatures which exist in the grinding and cooling chambers.

2. A grinder according to claim 1, wherein said jacket structure includes an end cap positioned adjacent the other end of said inner sleeve member for closing said grinding chamber, said end cap being fixedly connected to said outer sleeve member and being axially spaced from the adjacent end of said inner sleeve member for permitting said inner sleeve member to axially expand and contract, and seal means coacting between said end cap and said inner sleeve member for preventing the product from escaping from said grinding chamber.

3. A grinder according to claim 2, wherein said jacket structure includes an annular collar positioned in surrounding relationship to said inner sleeve member adjacent the other end thereof, said collar being disposed in sealed and axially slidable relationship with said inner sleeve member, and said collar being fixedly connected to both said outer sleeve member and said end cap.

4. A grinder according to claim 1, wherein said jacket structure includes an annular collar positioned in surrounding relationship to said inner sleeve member adjacent the other end thereof, said collar being axially slidably supported relative to said inner sleeve member, annular ringlike seal means coacting between said collar and said inner sleeve member for creating a sealed relationship therebetween to prevent the escape of coolant from the cooling chamber, and said collar being fixedly connected to the other end of said outer sleeve member.

5. A grinder according to claim 4, wherein said jacket structure includes an end wall positioned adjacent the other end of said sleeve members for closing said grinding chamber, said end wall being fixedly connected to said annular collar and being free of fixed connection with said inner sleeve member for permitting the latter to freely axially expand and contract relative to the outer sleeve member.

6. A grinder according to claim 1, including annular collar means coacting between the housing and said one end of the jacket structure for fixedly but removably mounting the jacket structure to the housing.

7. A grinder according to claim 1, wherein the axle has a first elongated axle portion which is rotatably supported on the housing and is joined to a second axle portion which is cantilevered from the housing and projects into the grinding chamber, a seal structure and a bearing structure coacting between the housing and the first axle portion, an elongated interior passageway extending axially of the first axle portion, a rotatable dual-passage joint mounted on the free end of the first axle portion for supplying and draining a liquid coolant to and from the interior passageway, and a tube structure disposed within said interior passageway to divide the latter into two separate passages which extend axially of the first axle portion, with one of said passages being used to permit the supply of coolant and the other being used to permit the drainage of coolant.

* * * * *